United States Patent [19]

Krasnov

[11] 4,389,760

[45] Jun. 28, 1983

[54] WELL SLIP UNIT

[75] Inventor: Igor Krasnov, Huntington Beach, Calif.

[73] Assignee: Varco International, Inc., Orange, Calif.

[21] Appl. No.: 101,151

[22] Filed: Dec. 7, 1979

[51] Int. Cl.[3] ..... A44B 21/00

[52] U.S. Cl. ..... 24/263 D; 24/263 DA; 24/263 R

[58] Field of Search ..... 24/263 D, 263 DA, 263 DT, 24/263 DB, 263 DC, 263 DH, 263 DN, 263 DP, 263 DQ, 263 R

[56] References Cited

U.S. PATENT DOCUMENTS

| | | | |
|---|---|---|---|
| 1,725,459 | 8/1929 | Krell et al. | 24/263 R X |
| 1,844,378 | 2/1932 | Campbell | 24/263 R X |
| 2,231,923 | 2/1941 | Koen | 24/263 R X |
| 2,589,159 | 3/1952 | Stone | 24/263 DA X |
| 2,623,257 | 12/1952 | Moon | 24/263 DA |
| 2,698,734 | 1/1955 | Tremolada | 24/263 DA |
| 2,814,461 | 11/1957 | Martin | 24/263 DA |
| 4,203,182 | 5/1980 | Boyadsieff | 24/263 D |

FOREIGN PATENT DOCUMENTS

| | | | |
|---|---|---|---|
| 378997 | 6/1921 | Fed. Rep. of Germany | 24/263 D |

*Primary Examiner*—Roy D. Frazier

*Assistant Examiner*—Peter A. Aschenbrenner

*Attorney, Agent, or Firm*—William P. Green

[57] ABSTRACT

A slip unit for releasably supporting a well pipe, including a support structure to be positioned on and turn with a rotary table and preferably taking the form of a slip bowl, and a vertically movable slip carrier structure suspending a number of pipe-gripping slips and adapted to be releasably retained by latch means in a lower active position, with the carrier and slips being yieldingly urged upwardly to inactive positions when the latch means are released. The support structure and carrier structure are both desirably formed of complementary sections hinged for relative swinging movement between closed positions about the pipe and open positions permitting movement of the unit laterally relative to the pipe, and with an additional latch being provided for retaining the structures in their closed positions. The carrier structure and slips are urged upwardly by spring cartridges which are removable as units from the slip assembly in a condition maintaining the actuating springs under compression and preventing injury or damage by release of the spring force during removal. Vertical guides are provided circularly between the slips for centering a well pipe in a manner preventing damage to the slips by engagement with enlargements on the pipe.

22 Claims, 10 Drawing Figures

WELL SLIP UNIT

BACKGROUND OF THE INVENTION

This invention relates to well slip units for releasably supporting a well pipe from a rotary table.

The slip units of the present invention are of a general type similar to those shown in prior copending applications Ser. No. 3,293 filed Jan. 15, 1979 (a continuation of Ser. No. 877,309 filed Feb. 13, 1978), and Ser. No. 12,130 filed Feb. 14, 1979. Those prior applications show devices including a support structure which is adapted to be supported by and to turn with a well drilling rotary table, and a carrier structure suspending a number of slips and mounted for upward and downward movement with the slips between a lower active pipe-gripping position and an upper retracted position. Latch means are provided for releasably retaining the carrier and slips in their lower active positions, together with yielding means for returning the carrier and slips upwardly when the latch means are released. In certain instances, the support structure desirably takes the form of a slip bowl, having inner tapering surfaces for camming the slips inwardly into engagement with the well pipe upon downward movement of the slips. In another arrangement, as shown for example in application Ser. No. 12,130, a separate slip bowl may be employed.

SUMMARY OF THE INVENTION

In units embodying the present invention, the support structure which is placed on the rotary table and the relatively vertically movable slip carrier structure are both preferably formed of complementary sections which are interconnected for relative swinging movement between closed positions of extension about the well pipe and open positions providing a lateral opening through which the well pipe may pass to permit movement of the unit horizontally between a position about the pipe and a position at a side of the pipe. A latch may be provided for releasably retaining the structures in their closed active positions, and is desirably carried by the discussed support structure.

An additional feature of the invention relates to the construction of the yielding means for urging the slips and their carrier upwardly relative to the lower support structure when the carrier is released from its lower active position. For this purpose, I desirably employ a number of spring cartridges, including vertically extending coil springs maintained under compression to exert upward force against the slip carrier and downward force against the lower support structure. Each of these cartridges is so constructed as to be removable as a unit from the remainder of the device, with the cartridge being designed to maintain the spring under compression during removal in a manner preventing injury to a workman or damage to the equipment by release of the spring tension during such disassembly. A cartridge may therefore be removed in the field for repair or replacement, or during repair of other portions of the equipment, with safety. If desired, a damaged spring cartridge may be replaced by another such cartridge, and the damaged one be returned to the factory or other repair location with the spring still under compression until it can ultimately be disassembled by trained personnel and with proper equipment for effectively preventing injury or damage by the spring force during disassembly. To achieve these results, the cartridge includes two elements at opposite ends of the spring against which the force of the spring is exerted, together with stop means limiting relative separating movement of those elements in a manner retaining the spring under compression as the elements and spring are removed from the remainder of the apparatus as a unit. Each of the two elements may have a projection which in assembled condition of the apparatus is received within an opening in either the lower support structure or the upper slip carrier structure, and is connectable thereto by a fastener. The stop apparatus may consist of telescopically interfitting parts attached to the two end elements and having shoulders limiting relative axial separating movement thereof.

To protect the slips against damage by contact with enlarged joints or other enlargements on the well pipe, a unit embodying the invention may include vertically extending pipe centering guides located circularly between the slips and engageable with a well pipe (or enlargement thereon) to center it and thereby hold it out of contact with the slips when the latter are retracted. These guides may be carried by the lower support structure and project upwardly thereabove.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
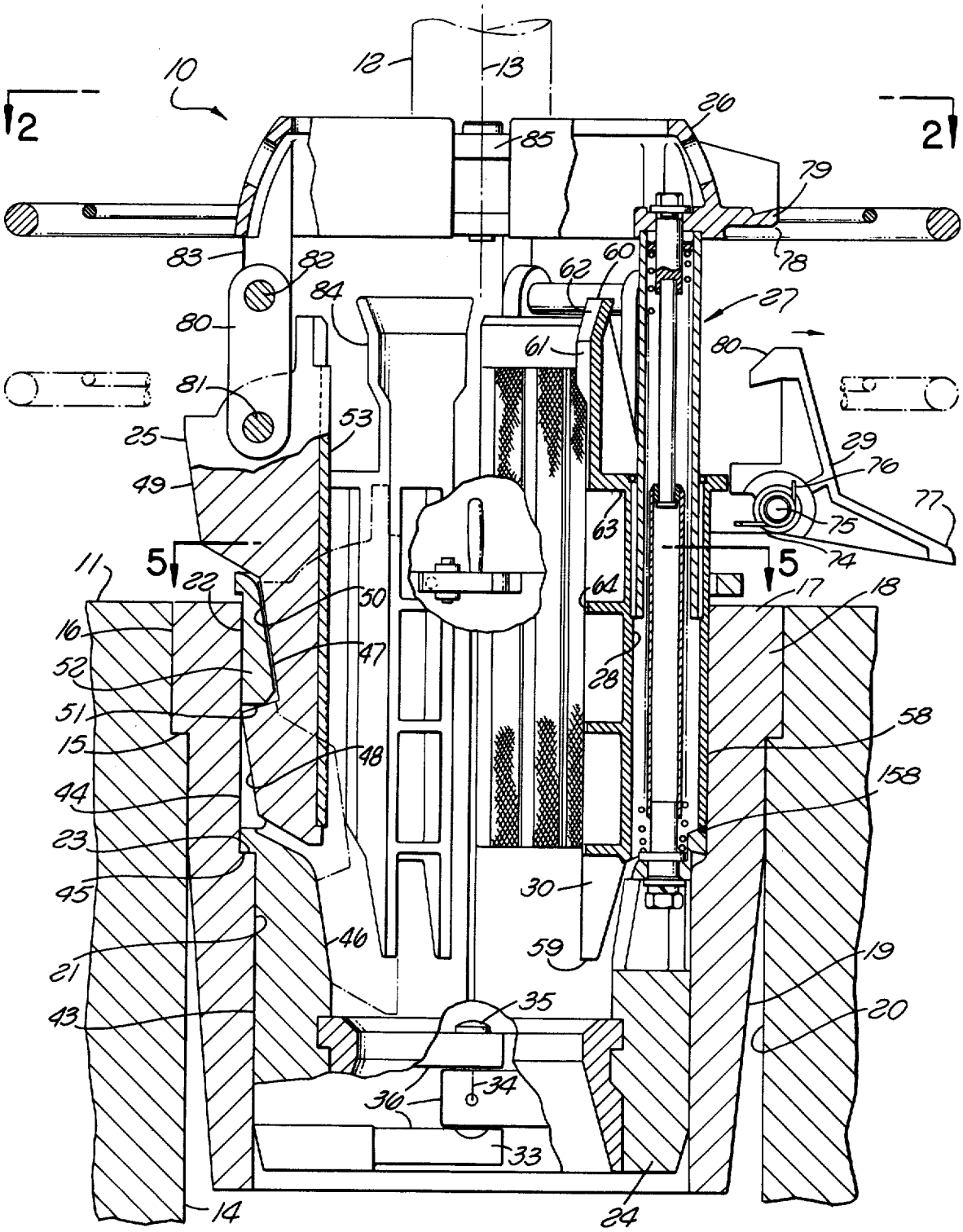
FIG. 1 is a central vertical section through a well slip unit constructed in accordance with the invention, shown positioned in a rotary table and with a well pipe extending vertically therethrough, and taken on line 1—1 of FIG. 2.
Figure 2:
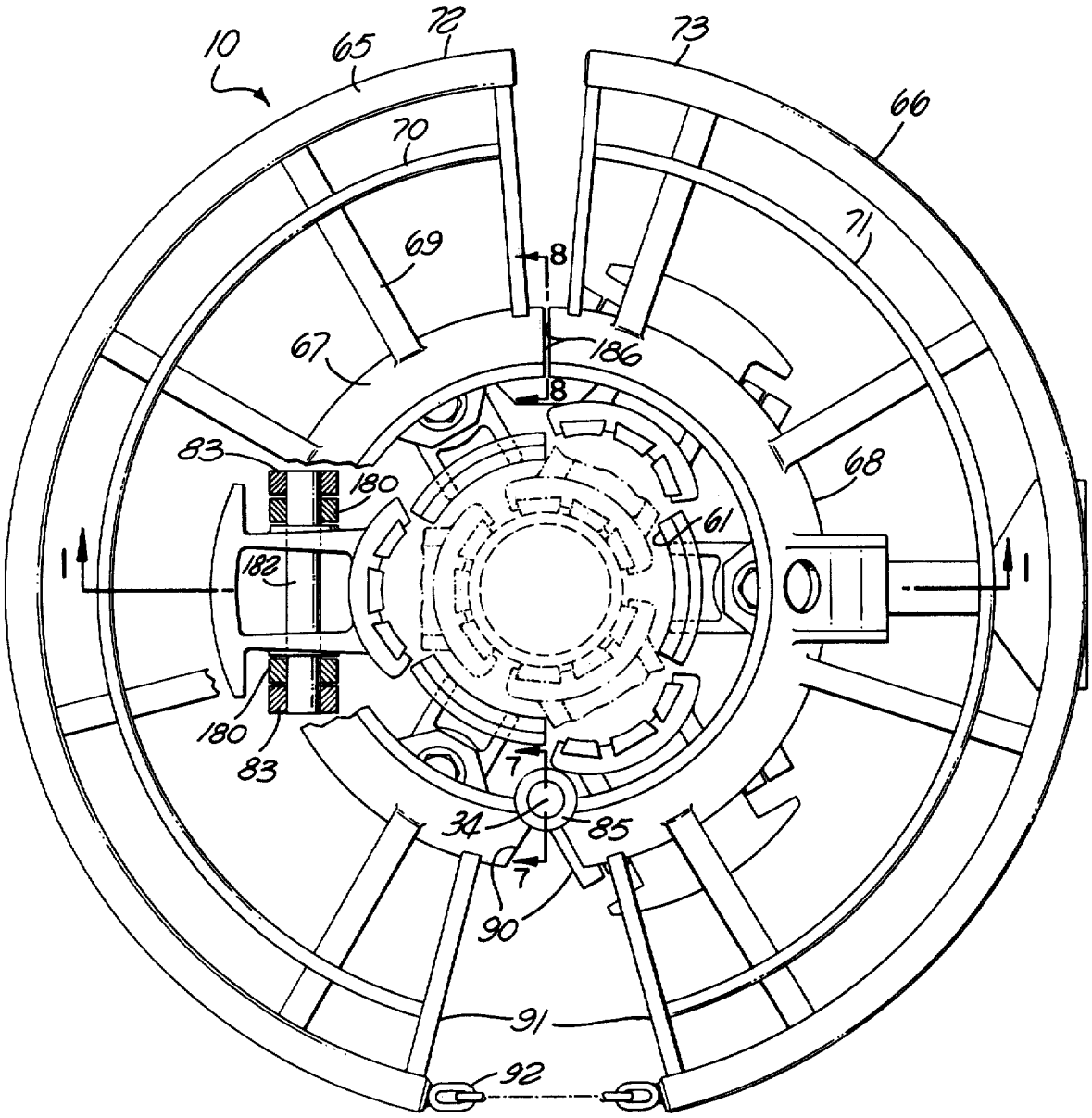
FIG. 2 is a plan view on line 2—2 of FIG. 1.

Referring first to FIGS. 1 and 2, there is illustrated at 10 a slip assembly constructed in accordance with the invention, shown positioned within and supported by the rotating member 11 of a well drilling rotary table. A well pipe 12 extends vertically along an axis 13 through the center of the rotary table and through slip assembly 10 to be supported thereby while connections are made to the upper end of the pipe. The rotary table member 11 is power driven about axis 13, and contains a central vertically extending opening 14 through which the pipe extends. Opening 14 is of circular cross-section up to the location of a horizontal support shoulder 15 at the bottom of an upper enlarged square drive recess 16 which receives an upper square portion 17 of a tubular master bushing 18 to support the master bushing in the rotary table and turn the bushing with the table. A lower portion 19 of the master bushing projects downwardly within the lower circular portion 20 of rotary table opening 14. Internally, master bushing 18 has a lower cylindrical portion 21 and an upper slightly enlarged diameter cylindrical portion 22, with an annular generally horizontal support shoulder 23 at the juncture of portions 21 and 22 to support the unit 10 in the master bushing.

The slip unit 10 includes a lower support structure 24 forming a slip bowl, a plurality of (typically three) pipe supporting slips 25, and an upper slip carrier 26. The carrier 26 and the suspended slips 25 are guided for only vertical movement relative to slip bowl 24, and are yieldingly urged upwardly to the FIG. 1 retracted position, by a number of guide and spring cartridges 27 coacting with vertical guide passages 28 in the slip bowl structure. The carrier 26 and slips are releasably retainable in lower active positions (FIG. 3) by a spring-urged latch element 29. Enlargements on the well pipe are centered in the device by three circularly spaced vertical guide members 30 carried by the slip bowl structure 24.

Figure 5:
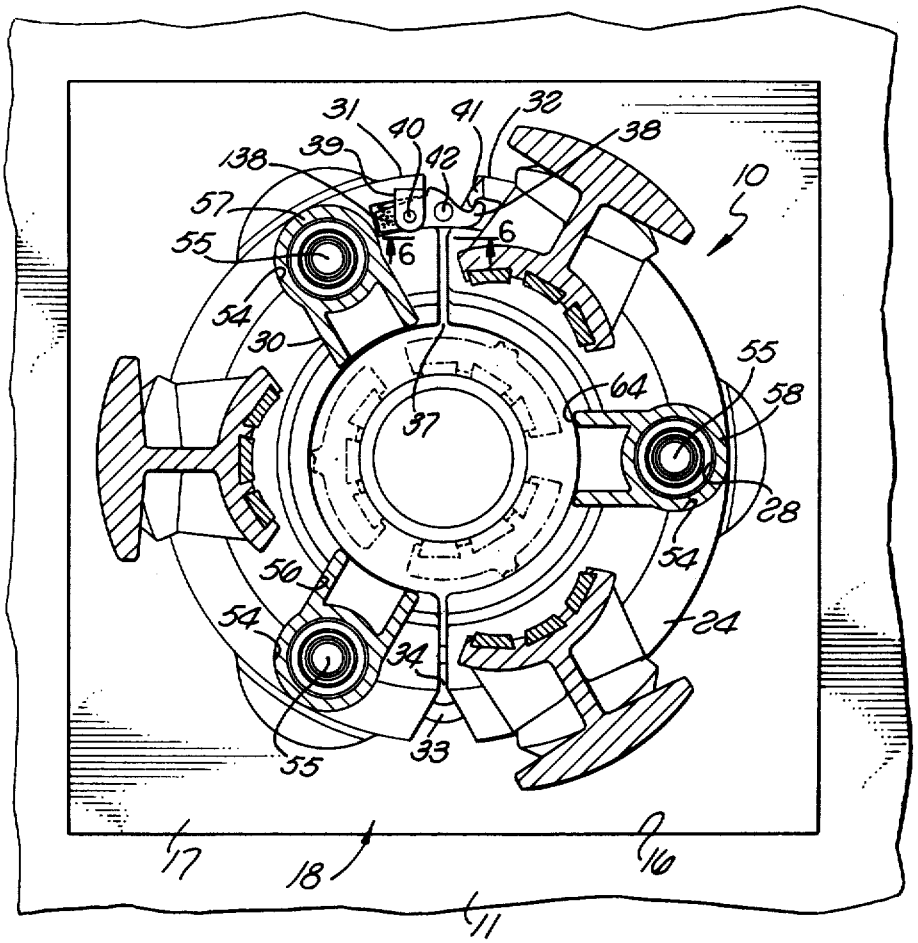
FIG. 5 is a horizontal section taken on line 5—5 of FIG. 1.
Figure 6:
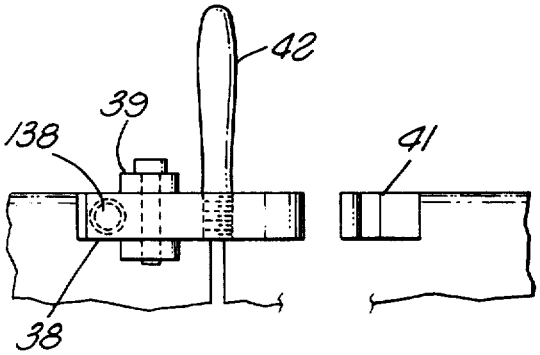
FIG. 6 is a fragmentary view taken on line 6—6 of FIG. 5 and showing the slip bowl sections and their latch elements in slightly open condition.

As best seen in FIGS. 2 and 5, the slip bowl or support structure 24 includes two similar semi-circular and complementary bowl sections 31 and 32, connected together at their lower ends by a hinge 33 for relative horizontal swinging movement about an axis 34 offset from and parallel to the main vertical axis 13 of the device. Hinge 33 may include a vertical hinge pin 35 received within aligned openings in hinge lugs 36 carried by the two sections 31 and 32. The two bowl sections are free to swing between the closed position of FIG. 5 in which their free ends 37 are in closely proximate relation, and an open position in which those end surfaces are spaced apart far enough to form therebetwen an opening larger in diameter than pipe 12 and permitting the device to be moved horizontally between a position about the pipe and a laterally offset position at a side of the pipe. The bowl is retained in the closed condition by a latch element 38 mounted to the end of section by bearing lugs 39 for relative pivotal movement about a vertical axis 40, and engageable with a hook element 41 welded to the end of the second bowl segment 32 to latch the ends of the bowls against relative separating or opening movement. A coil spring 138 contained within a recess in latch part 38 and bearing against a surface on bowl segment 31 yieldingly urges the latch to its holding position, while an upwardly projecting handle arm 42 permits manual pivotal actuation of latch element 38 about axis 40 and out of engagement with the coacting latch part 41 to release the bowl segments for opening movement.

When the two bowl segments 31 and 32 are in their closed condition of FIG. 5, they form together an essentially circular tubular or annular bowl having outer cylindrical surfaces 43 and 44 engageable with master bushing surfaces 21 and 22, and having an annular downwardly facing support shoulder 45 engageable with support shoulder 23 of the master bushing to support and center the slip bowl structure within the master bushing. Internally, this annular two segment bowl has a lower downwardly tapering frusto-conical cam surface 46 which is circularly continuous except at the locations of the vertical guide members 30, and an upper downwardly tapering frusto-conical camming surface 47 which is similarly continuous circularly and about axis 13 except at the locations of the vertical guides 30. As will be apparent from FIG. 1, these two camming surfaces 46 and 47 are in alignment with one another frusto-conically, and taper at a corresponding angle, to engage outer similarly downwardly tapering cam surfaces 48 and 49 on slips 25 to cam the slips inwardly into tight gripping engagement with the pipe when the slips are in the broken line position of FIGS. 1, 2 and 5. Vertically between the two outer cam surfaces 48 and 49, each slip contains an external recess 50 as seen in FIG. 1. Vertically between the two cam surfaces 46 and 47 of the slip bowl, the essentially annular wall of that bowl contains at the location of each of the slips an opening 51, which extends through the entire radial thicknes of the wall to its outer surface 44. When each slip 25 is in its upper full line retracted position of FIG. 1, the lower portion of the slip on which surface 48 is formed projects outwardly into a coacting one of the openings 51 in the wall of the slip bowl, and the upper portion 52 of the bowl above that opening is received within the recess 50 of the slip, to maximize the movement of the slip radially outwardly from its active pipe gripping position and thereby allow reception between the retracted slips of relatively large joints or enlargements on the pipe. At its radially inner side, each of the slips 25 may be curved arcuately in horizontal section in correspondence with the outer surface of the well pipe 12, and carry conventional pipe gripping dies 53 having gripping teeth curving arcuately in correspondence with the outer surface of the pipe and shaped to effectively support the pipe when the slips are in their lower active broken line position of FIG. 1.

The three vertical guide members 30 are rigidly carried by the two slip bowl segments 31 and 32, and may if desired be formed integrally with those segments, but preferably are cast or otherwise formed separately and then rigidly secured to the segments by welding or otherwise. More particularly, as seen in FIG. 5, the two segments 31 and 32 may initially be formed to contain three evenly circularly spaced vertically extending cylindrical recesses or bores 54 centered about three vertical axes 55 and opening horizontally inwardly to the interior of the slip bowl structure at 56. Each of the guide members 30 is formed as a radially inner portion of a member 57 having a vertically extending cylindrical tubular portion 58 received within one of the vertical passages 54 formed in a corresponding one of the bowl segments 31 or 32, and appropriately welded to the bowl segment as at 158 in FIG. 1. The vertical pipe guide portion 30 may be considered as extending vertically from a lower extremity 59 (FIG. 1) to an upper extremity 60, and has inner surfaces 61 extending essentially cylindrically about vertical axis 13 of the device to define together an interrupted essentially circular guide structure of a diameter larger than pipe 12 for engaging enlarged joint ends or enlarged rubber sleeves or the like carried on the outside of the pipe. These enlargements on the pipe when thus centered by guide elements 30 are held in positions in which they cannot contact and damage the slips when the slips are in their retracted positions (FIGS. 1 and 2 full line positions of the slips). At their upper ends, the inner surfaces of guide members 30 may flare outwardly frustoconically at 62, to cam the pipe enlargement into centered positions as the pipe moves downwardly. In order to lighten the guide members, the cylindrical surfaces 61 may be discontinuous, with a number of recesses 63 being formed in the radially inner sides of the guide members, but with the various inner surfaces 64 of the ribs which bound recesses 63 being disposed cylindrically as discussed for centering contact with the pipe. The outer cylindrical portions 58 of the parts 57 which form guides 30 contain the previously mentioned vertical cylindrical guide passages 28 which coact with spring cartridges 27 in a manner to be discussed in greater detail at a later point.

The upper slip carrier 26 may be considered as extending generally horizontally at a location spaced above the slip bowl 24, and is composed of two complementary essentially semi-circular sections or segments 65 and 66 forming together an essentially annular carrier. The sections 65 and 66 may include inner complementary semi-circular castings 67 and 68, rigidly attached by radially extending spokes 69 to radially spaced inner ring segments 70 and 71 and outer ring segments 72 and 73. The two ring segments 70 and 71 form together an almost circularly continuous annular horizontal structure, while the outer ring segments 72 and 73 are also substantially complementary and substantially continuous and form together a second horizontal ring about the pipe. One or more workmen may stand on the rings 70 through 73 and the associated spokes 69 to urge the carrier downwardly by the weight of the workmen and to the active pipe supporting position of FIG. 3. The carrier is releasably retained in that lowered position by latch element 29, which is pivotally connected to the slip bowl structure by attachment to an outwardly projecting bearing lug 74 on one of the members 57. Latch element 29 pivots about a horizontal axis 75 relative to the connected slip bowl segment, and is urged yieldingly in a counterclockwise direction about axis 75 as viewed in FIG. 3 by a torsion spring or other spring 76. The latch is released by downward actuation of an operating arm 77 on the latch element, which arm extends generally horizontally and may be pressed downwardly by the foot of a workman. As carrier 26 is moved downwardly from the FIG. 1 position to the FIG. 3 position, a camming shoulder 78 at the underside of a latch shoulder 79 on the carrier engages inclined surface 80 on the latch element 29 to deflect the latch element in a clockwise direction sufficiently to pass latching shoulder 79 and then return inwardly at the upper side of that shoulder to the FIG. 3 position in which the latch element releasably retains the carrier in its lowered active position.

Figure 10:
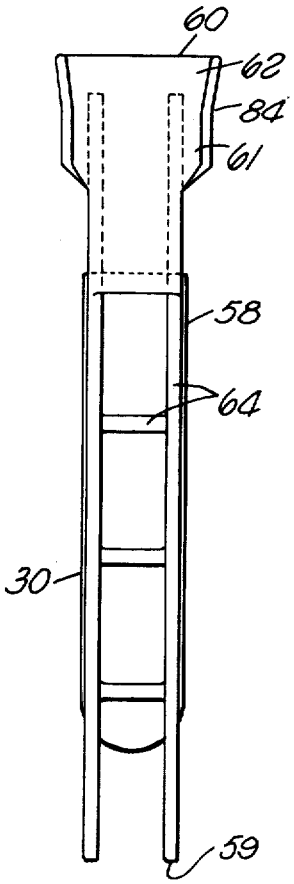
FIG. 10 is a reduced elevational view of one of the vertical guides, taken on line 10—10 of FIG. 3.

The slips are suspended movably from carrier 26 by links 180. Two such links are provided at opposite sides of each of the slips, with the lower ends of the links being pivoted by a horizontal pin 81 to the slip, and with the upper ends of the links being pivoted by a second parallel horizontal pin 82 to a pair of bearing lugs 83 projecting downwardly from one of the inner ring segments 67 or 68 of the carrier. The links thus permit inward deflection of the slips as they move downwardly with the carrier, to thereby grip the pipe. One of the guide members 30 is provided circularly between each pair of adjacent slips, with the inner cylindrically curving surfaces 61 and 64 of the guide members 30 being closer to axis 13 than are the gripping surfaces or any portions of the slips in the radially outwardly retracted positions of the slips (full lines in FIGS. 1, 2 and 5). In the active pipe-gripping positions of the slips (broken lines in FIGS. 1, 2 and 5), the inner gripping edges of the slips are closer to axis 13 of the device than are inner cylindrically curved guide surfaces 61 and 64 of guide members 30. It is also noted that the upper end portions of the vertical guide members 30, at a level above the locations of the slips when they are in gripping engagement with the pipe, may be somewhat wider circularly than are the lower portions of members 30, as illustrated at 84 in FIGS. 1 and 10, in order to maximize the guiding effectiveness of the upper portions of the guides while maintaining the lower portions of the guides sufficiently narrow to avoid interference with inward movement of the slips to their active gripping positions.

Figure 7:
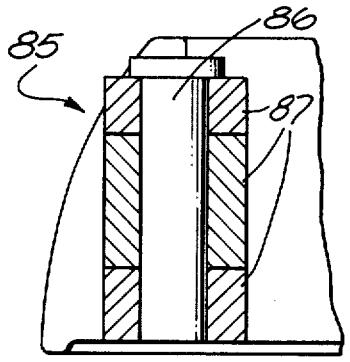
FIGS. 7 and 8 are enlarged fragmentary vertical sections taken on lines 7—7 and 8—8 respectively of FIG. 1.
Figure 8:
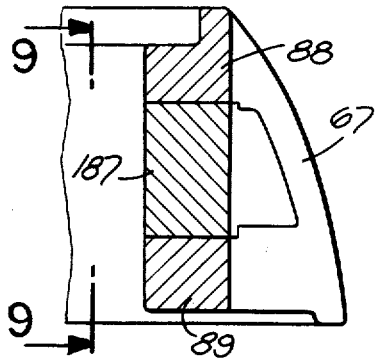
Figure 9:
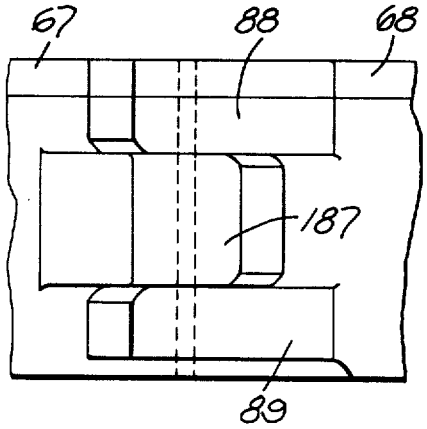
FIG. 9 is a fragmentary view taken on line 9—9 of FIG. 8.

The two complementary sections 65 and 66 of slip carrier 26 are connected together for relative swinging movement about the same axis 34 as are the two segments 31 and 32 of the bowl structure. For this purpose, a hinge 85 (FIGS. 1, 2 and 7) is formed between first ends of the two inner ring elements 67 and 68, by provision of a hinge pin 86 received within mating vertically aligned hinge lugs 87 projecting from the two elements 67 and 68 respectively. At their opposite ends, these parts 67 and 68 have end surfaces 186 which move between closely proximate closed positions (FIG. 2) and separated open positions leaving a gap or passage between those surfaces through which the pipe 12 may pass to enable the device to be moved onto and off of the pipe. To enhance the rigidity of the closed structure, the parts 67 and 68 may have interfitting projections at their unattached ends, as represented in FIGS. 8 and 9, including a horizontally projecting lug 187 carried by part 67 and slidably receivable between two vertically spaced lugs 88 and 89 on the part 68 in the FIGS. 2, 8 and 9 closed position of the device to lock the free ends of parts 67 and 68 against relative vertical movement. At their hinge ends, the members 67 and 68 may be cut away at 90 (FIG. 2) to enable the desired opening movement of the carrier, and the ring elements 70 through 73 may be similarly interrupted at 91 to avoid interference by these rings with the opening of the carrier. A chain or other flexible but inextensible member 92 may interconnect the extremities of ring segments 72 and 73 as seen in FIG. 2, to limit the closing movement of the parts in the FIG. 2 position and form in effect a continuation of the ring elements at that location.

The three spring cartridges 27 for yieldingly urging slip carrier 26 and the carried slips upwardly relative to bowl 24 may be of identical configuration. Each of these cartridges includes a first rigid vertical guide tube 90 (FIG. 3) which is secured rigidly at its upper end to a vertically extending rigid connector member 91, with the connection desirably being made by a ring 92 received radially between the two parts 90 and 91 and welded to both of those parts in horizontally extending condition. The upper end of externally cylindrical part 91 projects upwardly through a cylindrical opening 93 in a horizontal wall 94 of one of the carrier parts 67 or 68, and is secured rigidly thereto by a bolt or other fastener 95 threadedly connected to internal threads in part 91 and clamping a washer 96 against wall 94. This connection secures tube 90 in a position in which its axis 97 extends directly vertically and parallel to central axis 13 of the slip unit.

Each of the tubes 90 extends downwardly into one of the vertical passages 28 in one of the parts 57 of the slip bowl assembly, and is guided thereby for only directly vertical movement along the axis 97 of that tube. To enhance the effectiveness of this guiding action, each of the passages 28 may contain in an upper portion thereof a vertical tubular bushing 98 of brass or other suitable bearing material, having an internal cylindrical surface slidably engaging the outer cylindrical surface of the tube 90. A deformable seal ring 99 of rubber or other material prevents access of foreign material to the bushing.

At the lower end of each of the guide passages 28 in the slip bowl structure, there is provided a horizontal rigid bottom wall 100, containing a circular opening 101 through which an externally cylindrical portion 102 of a bottom connector element 103 projects, with an annular flange element 104 being welded to the outside of element 103 and being engageable downwardly against the upper surface of bottom wall 100 to apply downward force thereto. A screw 105 is connectable upwardly into an internally threaded bore 106 in part 103, to clamp a washer 107 and associated lock washer 108 upwardly against wall 100 in a manner rigidly securing part 103 thereto in vertically extending position, centered about the previously mentioned vertical axis 97. A coil spring 109 extends vertically between flange 104 and the previously mentioned flange 92, to yieldingly urge the slip carrier upwardly relative to the bowl assembly. This spring is at all times maintained under compression, and remains under compression even when the slip carrier is in its upper FIG. 1 position. The upward movement of the carrier is limited in that position by engagement of a rod 110 rigidly secured to and projecting downwardly from member 91 with a telescopically interfitting rigid tube 111 secured rigidly to and projecting upwardly from lower element 103. These two parts 110 and 111 are centered about and move relative to one another along axis 97, with the upper end of rod 110 typically being received within a recess 112 in part 91 and being welded thereto as represented at 113. The lower end of tube 111 may be received about the upper extremity of part 103, and be welded or otherwise secured thereto at 114. At its upper end, tube 111 is welded to and carries a short internal sleeve 115 forming a shoulder engageable with enlarged diameter flange 116 formed on the lower end of rod 110 to limit upward movement of the slip carrier and slips in the FIG. 1 position of the parts.

To discuss now the manner of use of the unit 10 illustrated in the drawings, assume first of all that a pipe 10 is in a position of extension through the rotary table 11 of FIG. 1, and assume that the master bushing 18 is already positioned in the table. Assume also that the unit 10 is initially at a side of the well. In order to permit the unit 10 to be moved to a position of support on the rotary table, an operator first releases the latch element 38 of FIG. 5, to enable the entire device to be swung open about the two hinges 33 and 85. The two segments 31 and 32 of the slip bowl swing open about their hinge 33, while the two sections or segments 65 and 66 of the carrier 26 simultaneously swing open, with the vertical guide and spring cartridges 27 serving to interconnect the carrier and bowl segments for swinging movement in unison. The entire unit is then moved horizontally to a position about pipe 12, and then lowered about the pipe until the slip bowl structure 24 extends downwardly into the master bushing and is supported thereby in the position of FIG. 1. When it is desired to grip pipe 12 in supporting relation, one or more workmen stand on the rings of the carrier 26 to actuate the carrier downwardly against the tendency of the compression springs 109 by the weight of the workmen. The strength of the springs is so predetermined, in conjunction with the weight of the vertically movable parts, as to enable such downward actuation by a predetermined weight, desirably at least about 100 pounds and preferably approximately 400 pounds, to permit effective actuation of the carrier when desired while preventing unintended accidental downward displacement of the slips.

Figures 3, 4:
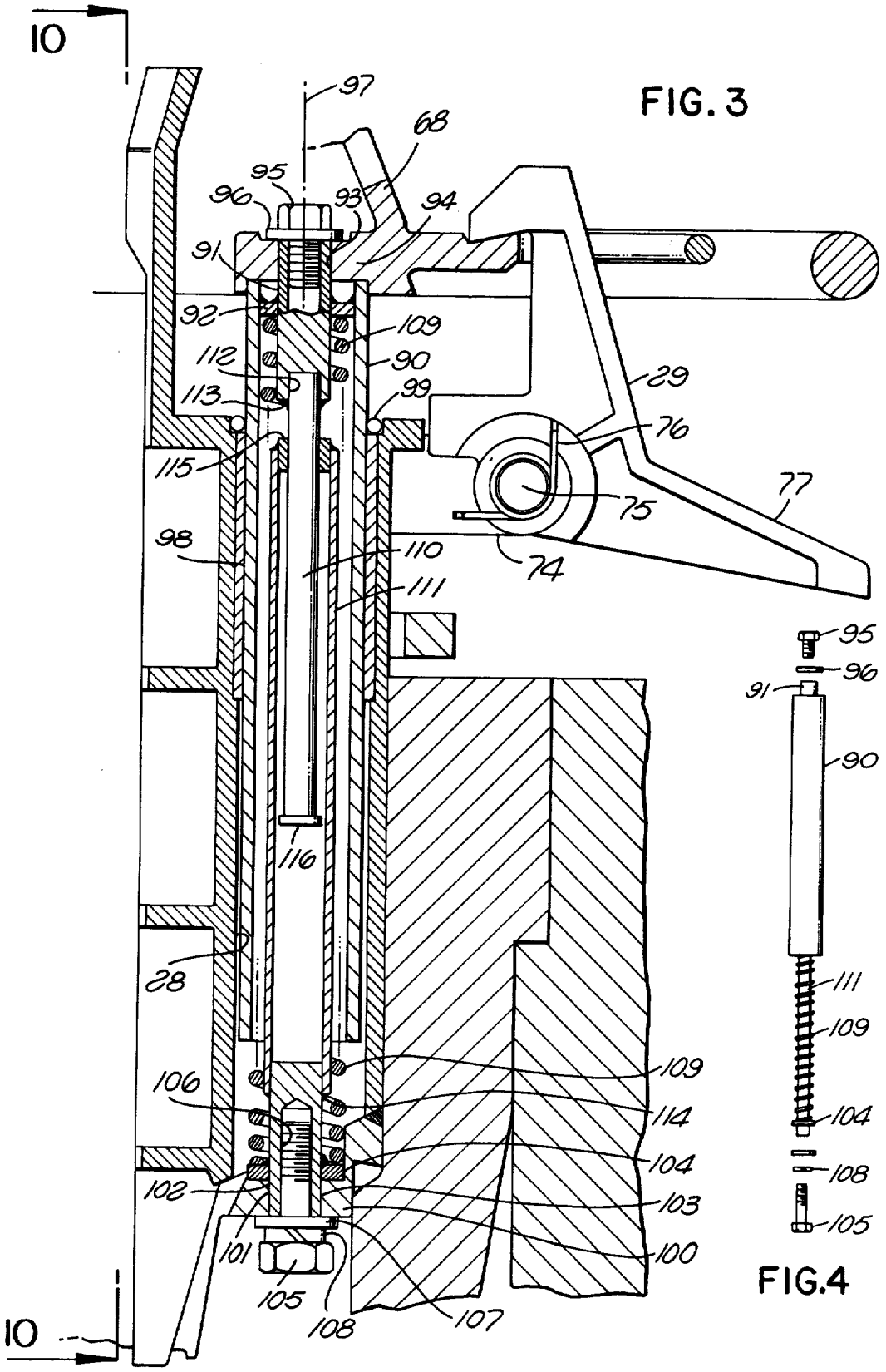
FIG. 3 is an enlargement of a portion of FIG. 1, showing the slip carrier latched in its lower active position.
FIG. 4 is a reduced scale illustration of one of the spring cartridges removed from the device.

As the carrier and slips move downwardly, the slips are deflected inwardly toward the pipe by bowl surfaces 46 and 47, and in the lower active FIG. 3 position of the parts the slips effectively grip the pipe and very positively suspend it from the device 10 and the rotary table. The latch element 29 engages shoulder 79 of the carrier to retain it and the slips in their active pipe-suspending positions. When it is desired to release the slips, an operator merely presses downwardly on arm 77 of latch element 29, to move the upper hook portion of the latch element out of engagement with shoulder 79 and permit slip carrier 26 and the suspended slips to be returned upwardly by the force of the three return springs 109. The device 10 may be left in the rotary table while the pipe 12 is lowered or raised for a next successive connecting or disconnecting operation, with the vertical guides 30 engaging and centering any enlargements on the pipe to prevent contact of those enlargements with the laterally retracted slips. The device may then be reactuated to again support the pipe in a changed position.

If it becomes necessary or desirable to partially disassemble the device, and in particular to remove one or more of the cartridges 27, this may be done without releasing the springs from compression. To attain such detachment of the cartridges, the upper and lower cartridge attaching screws 95 and 105 are threadedly detached from the connected elements 91 and 103, so that the carrier and its slips can be withdrawn upwardly, leaving the cartridges 27 free for upward removal from the passages 28 in the slip bowl structure. FIG. 4 illustrates the cartridges thus removed. In this condition, the engagement of flange 116 on rod 110 with the upper sleeve 115 in tube 111 (as seen in FIG. 1) limits expansion of the spring and holds it in compressed condition during detachment from the rest of the apparatus. Substitute cartridges 27 may then be replaced in the unit, and the entire device reassembled, all without any danger of injury or damage to parts by release of the spring force.

The formation of slip bowl structure 24 to have openings 21 extending entirely through the wall thickness of that bowl maximizes the radial displacement and radial retraction of the slips which is possible between active and retracted positions of the slips while at the same time minimizing the thickness of the wall dimension.

While a certain specific embodiment of the present invention has been disclosed as typical, the invention is of course not limited to this particular form, but rather is applicable broadly to all such variations as fall within the scope of the appended claims.

I claim:

1. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions; and yielding means urging said carrier structure and slips upwardly and acting to return them to said upper retracted positions when said latch means are released;

said yielding means including a unit which is removable from said slip assembly for repair or replacement;

said unit including a vertically extending spring acting upwardly against said carrier structure and downwardly against said support structure to yieldingly urge the carrier structure upwardly relative to the support structure, a first element at the top of said spring urged upwardly thereby, a second element at the bottom of said spring urged downwardly thereby, and stop means acting when said unit is removed from said slip assembly to limit upward movement of said first element relative to said second element in a position maintaining said spring under compression.

2. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released; and a plurality of centering guide elements at locations circularly between said slips and projecting radially inwardly therebeyond when the slips are in said retracted positions to avoid damage to the slips by engagement with enlargements on the well pipe, said slips in their active positions projecting closer to the axis of the well pipe than do said centering guide elements.

3. A slip assembly comprising:

a slip bowl adapted to be supported on a well drilling rotary table in a relation to turn with the table;

a carrier structure mounted to said slip bowl for upward and downward movement relative thereto;

a plurality of slips which have inner faces for gripping a well pipe and which are connected to said carrier structure for movement upwardly and downwardly therewith relative to said slip bowl between lower active positions and upper retracted positions;

said slips and said bowl having interengageable wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released; and a plurality of centering guide elements carried by said slip bowl at locations circularly between said slips and projecting radially inwardly therebeyond when the slips are in said retracted positions and engageable with enlargements on the well pipe to center them and avoid damage to the slips by engagement therewith, said slips in their active positions projecting closer to the axis of the well pipe than do said centering guide elements.

4. A slip assembly as recited in claim 3, in which said guide elements have upper extremities projecting upwardly beyond said slips in the active positions of the slips and which are wider than lower portions of the guide elements received circularly between the slips in their active positions.

5. The combination comprising:

a slip bowl; and a plurality of slips receivable within and movable relative to said slip bowl;

an individual one of said slips having two vertically spaced outer camming surfaces which taper to a reduced diameter as they advance downwardly, and having a recess extending radially inwardly vertically between said camming surfaces;

said slip bowl having a vertically extending side wall with two vertically spaced camming surfaces formed at the inside thereof, which surfaces taper essentially in correspondence with said surfaces of said individual slip and are engageable therewith in a lowered active position of the slip;

said side wall of the slip bowl containing an opening extending entirely through the radial thickness of said side wall vertically between said two spaced surfaces of the bowl and into which a lower one of said two camming surfaces on said individual slip is movable in an upper retracted position of the slip.

6. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released;

said yielding means including a unit which is removable from said slip assembly for repair or replacement;

said unit including a vertically extending spring acting upwardly against said carrier structure and downwardly against said support structure to yieldingly urge the carrier structure upwardly relative to the support structure, a first element at the top of said spring urged upwardly thereby, a second element at the bottom of said spring urged downwardly thereby, and stop means acting when said unit is removed from said slip assembly to limit upward movement of said first element relative to said second element in a position maintaining said spring under compression; and means for detachably connecting said first and second elements to said carrier structure and support structure respectively.

7. A slip assembly as recited in claim 6, in which said connecting means include a projection on one of said elements extending vertically through an opening in a corresponding one of said structures and threadedly connectible to a fastener for detachably securing said element to said structure.

8. A slip assembly as recited in claim 6, in which said stop means include telescopically interfitting parts attached to said elements and having stop shoulders engageable to limit relative vertical separating movement of said elements.

9. A slip assembly as recited in claim 6, in which said unit includes a tube projecting vertically from one of said elements and a rod projecting in an opposite vertical direction from the other element and slidably received within said tube and having a shoulder near an end of the rod engageable with a shoulder in the tube to limit relative vertical separating movement of the elements.

10. A slip assembly as recited in claim 9, in which said spring is a coil spring disposed about said tube and rod.

11. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released;

said yielding means including a unit which is removable from said slip assembly for repair or replacement;

said unit including a vertically extending spring acting upwardly against said carrier structure and downwardly against said support structure to yieldingly urge the carrier structure upwardly relative to the support structure, a first element at the top of said spring urged upwardly thereby, a second element at the bottom of said spring urged downwardly thereby, and stop means acting when said unit is removed from said slip assembly to limit upward movement of said first element relative to said second element in a position maintaining said spring under compression;

said stop means including a tube projecting vertically from one of said elements and a rod projecting in an opposite vertical direction from the other element and slidably received within said tube and having a shouler near an end of the rod engageable with a shoulder in the tube to limit relative vertical separating movement of the elements;

said spring being a coil spring disposed about said tube and rod;

each of said elements forming a projection extending through an opening in a corresponding one of said structures; and two threaded fasteners engageable with said projections to detachably secure the projections in said openings.

12. A slip assembly as recited in claim 11, in which said unit includes a second tube attached to one of said elements and disposed about said spring and slidably guided for relative vertical movement within one of said structures.

13. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions; and yielding means urging said carrier structure and slips upwardly and acting to return them to said upper retracted positions when said latch means are released;

said yielding means including a unit which is removable from said slip assembly for repair or replacement;

said unit including a vertically extending spring acting upwardly against said carrier structure and downwardly against said support structure to yieldingly urge the carrier structure upwardly relative to the support structure, a first element at the top of said spring urged upwardly thereby, a second element at the bottom of said spring urged downwardly thereby, and stop means acting when said unit is removed from said slip assembly to limit upward movement of said first element relative to said second element in a position maintaining said spring under compression;

said two elements forming projections extending vertically within openings in said two structures respectively; and two fasteners detachably engageable with said projections to retain them in said openings;

said unit including a tube connected to said first element and exerting force upwardly against said carrier structure and slidably received within a vertical recess in said support structure to guide the tube for vertical movement;

said spring being a coil spring disposed within said tube and having upper and lower ends bearing vertically against flanges on said two elements respectively;

said stop means including a second tube connected to said second element and projecting upwardly therefrom within said coil spring and having a downwardly facing internal shoulder at an upper end of said second tube, and said stop means including a rod projecting downwardly from said first element into said second tube and having an enlarged head engageable upwardly against said internal shoulder to limit relative vertical separating movement of said elements even when said unit is detached from said structures.

14. A slip assembly as recited in claim 13, including additional units constructed in correspondence with said first mentioned unit and acting to apply vertical separating force to the structures at locations offset circularly from the first unit, and each removable from the remainder of the slip assembly for repair or replacement.

15. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released;

a plurality of centering guide elements at locations circularly between said slips and projecting radially inwardly therebeyond when the slips are in said retracted positions to avoid damage to the slips by engagement with enlargements on the well pipe;

said centering guide elements being attached to said support structure.

16. A slip assembly as recited in claim 15, in which said centering guide elements extend vertically along approximately the entire vertical extent of said slips.

17. A slip assembly as recited in claim 15, in which said guide elements have upper extremities projecting upwardly beyond said slips in the active positions of the slips.

18. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released; and a plurality of centering guide elements at locations circularly between said slips and projecting radially inwardly therebeyond when the slips are in said retracted positions to avoid damage to the slips by engagement with enlargements on the well pipe;

said guide elements having upper extremities projecting upwardly beyond said slips in the active positions of the slips, said upper extremities of the centering guide elements having inner surfaces which advance progressively inwardly as they advance downwardly to deflect a well pipe inwardly to centered position.

19. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released;

a plurality of centering guide elements at locations circularly between said slips and projecting radially inwardly therebeyond when the slips are in said retracted positions to avoid damage to the slips by engagement with enlargements on the well pipe;

said centering guide elements being rigidly attached to and carried at the inside of said support structure;

said support structure containing vertical passages radially outwardly opposite said centering guide elements; and tubes projecting downwardly from said carrier structureand slidably received and guided within said passages;

said yielding means including coil springs contained within said tubes and passages.

20. A slip assembly comprising:

a slip bowl adapted to be supported on a well drilling rotary table in a relation to turn with the table;

a carrier structure mounted to said slip bowl for upward and downward movement relative thereto;

a plurality of slips which have inner faces for gripping a well pipe and which are connected to said carrier structure for movement upwardly and downwardly therewith relative to said slip bowl between lower active positions and upper retracted positions;

said slips and said bowl having interengageable wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released;

a plurality of centering guide elements carried by said slip bowl at locations circularly between said slips and projecting radially inwardly therebeyond when the slips are in said retracted positions and engageable with enlargements on the well pipe to center them and avoid damage to the slips by engagement therewith, said slips in their active positions projecting closer to the axis of the well pipe than do said centering guide elements;

said guide elements having radially outer portions which are secured to said slip bowl and contain vertical passages within which said yielding means are received.

21. A slip assembly comprising:

a slip bowl adapted to be supported on a well drilling rotary table in a relation to turn with the table;

a carrier structure mounted to said slip bowl for upward and downward movement relative thereto;

a plurality of slips which have inner faces for gripping a well pipe and which are connected to said carrier structure for movement upwardly and downwardly therewith relative to said slip bowl between lower active positions and upper retracted positions;

said slips and said bowl having interengageable wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released; and a plurality of centering guide elements carried by said slip bowl at locations circularly between said slips and projecting radially inwardly therebeyond when the slips are in said retracted positions and engageable with enlargements on the well pipe to center them and avoid damage to the slips by engagement therewith, said slips in their active positions projecting closer to the axis of the well pipe than do said centering guide elements;

said guide elements having radially outer portions which are secured to said slip bowl; and vertical elements connected to said carrier structure and projecting downwardly therefrom into said radially outer portions of the guide elements and telescopically interfitting therewith to guide the carrier structure for its vertical movement.

22. A slip assembly comprising:

a slip bowl adapted to be supported on a well drilling rotary table in a relation to turn with the table;

a carrier structure mounted to said slip bowl for upward and downward movement relative thereto;

a plurality of slips which have inner faces for gripping a well pipe and which are connected to said carrier structure for movement upwardly and downwardly therewith relative to said slip bowl between lower active positions and upper retracted positions;

said slips and said bowl having interengageable wedge surfaces for camming the slips inwardly into tight gripping engagement with a well pipe upon downward movement of the slips to said active positions;

latch means for releasably retaining said carrier structure and slips in said lower active positions;

yielding means urging said carrier structure and slips upwardly and acting to return them to said upper retracted positions when said latch means are released; and a plurality of centering guide elements carried by said slip bowl at locations circularly between said slips and projecting radially inwardly therebeyond when the slips are in said retracted positions and engageable with enlargements on the well pipe to center them and avoid damage to the slips by engagement therewith, said slips in their active positions projecting closer to the axis of the well pipe than do said centering guide elements;

said slip bowl containing vertical passages radially outwardly of said guide elements;

each of said guide elements being formed separately from said slip bowl and having a tubular radially outer portion received and secured within a corresponding one of said vertical passages in the slip bowl; and tubes attached to said carrier structure and telescopically received within said tubular portions of the guide elements to guide the carrier structure for its vertical movement relative to the slip bowl;

said yielding means including vertically extending coil springs received within said tubes and said tubular portions of the guide elements.

* * * * *